US011555662B2

(12) United States Patent
Kroyer et al.

(10) Patent No.: US 11,555,662 B2
(45) Date of Patent: Jan. 17, 2023

(54) MULTIFUNCTIONAL SLIDE COVER PLATE

(71) Applicant: GLOCK TECHNOLOGY GMBH, Ferlach (AT)

(72) Inventors: Josef Kroyer, Zemendorf (AT); Leopold Oppenauer, Ried im Innkreis (AT)

(73) Assignee: Glock Technology GmbH, Ferlach (AT)

( * ) Notice: Subject to any disclaimer, the term of this patent is extended or adjusted under 35 U.S.C. 154(b) by 0 days.

(21) Appl. No.: 17/476,196

(22) Filed: Sep. 15, 2021

(65) Prior Publication Data

US 2022/0163276 A1 May 26, 2022

(30) Foreign Application Priority Data

Nov. 24, 2020 (EP) ..... 20209578

(51) Int. Cl.
*F41A 3/66* (2006.01)
*F41C 3/00* (2006.01)

(52) U.S. Cl.
CPC . *F41A 3/66* (2013.01); *F41C 3/00* (2013.01)

(58) Field of Classification Search
CPC .. F41A 35/00; F41A 25/02; F41A 3/66; F41C 3/00; F41C 27/00
See application file for complete search history.

(56) References Cited

U.S. PATENT DOCUMENTS 9,285,186 B1 * 3/2016 Di Veroli ..... F41G 1/32
D761,374 S * 7/2016 Ellsworth ..... D22/108
9,664,471 B1 * 5/2017 Curry ..... F41A 3/72
10,139,174 B2 * 11/2018 Keller ..... F41C 3/00
10,837,725 B2 * 11/2020 Kim ..... F41A 19/13
2004/0200109 A1 * 10/2004 Vasquez ..... F41C 27/00 42/1.01
2011/0154710 A1 * 6/2011 Hatfield ..... F41A 19/34 42/90
2012/0198744 A1 * 8/2012 Meller ..... F41C 27/00 42/90
2013/0000173 A1 * 1/2013 Green ..... F41A 17/72 42/70.11
2014/0298703 A1 * 10/2014 Gale ..... F41A 3/72 42/71.02

(Continued)

FOREIGN PATENT DOCUMENTS

WO 2020157528 A1 8/2020

OTHER PUBLICATIONS

Search Report, established May 25, 2021 for related European patent application No. 20209578.

*Primary Examiner* — Joshua E Freeman
(74) *Attorney, Agent, or Firm* — Raven Patents, LLC; Anton E. Skaugset

(57) ABSTRACT

Slide cover plates, and handguns including the slide cover plates, where the slide cover plates include a primary cover plate portion and a sealing cover plate portion that is movably coupled to the primary cover plate portion so that the sealing cover plate portion has an open position and a closed position, and when in its closed position the slide cover plate provides protection for the interior of the handgun, and when in its open position the slide cover plate does not interfere with the forward movement of the pistol slide.

16 Claims, 6 Drawing Sheets

(56) References Cited

U.S. PATENT DOCUMENTS

| | | | | |
|---|---|---|---|---|
| 2015/0184966 | A1* | 7/2015 | Beck | F41A 17/64<br>42/70.08 |
| 2017/0138694 | A1* | 5/2017 | Finsand | F41C 33/008 |
| 2017/0211901 | A1* | 7/2017 | Keller | F41A 3/66 |
| 2021/0389078 | A1* | 12/2021 | Steindl | F41A 3/66 |

* cited by examiner

PRIOR ART

Fig. 3A
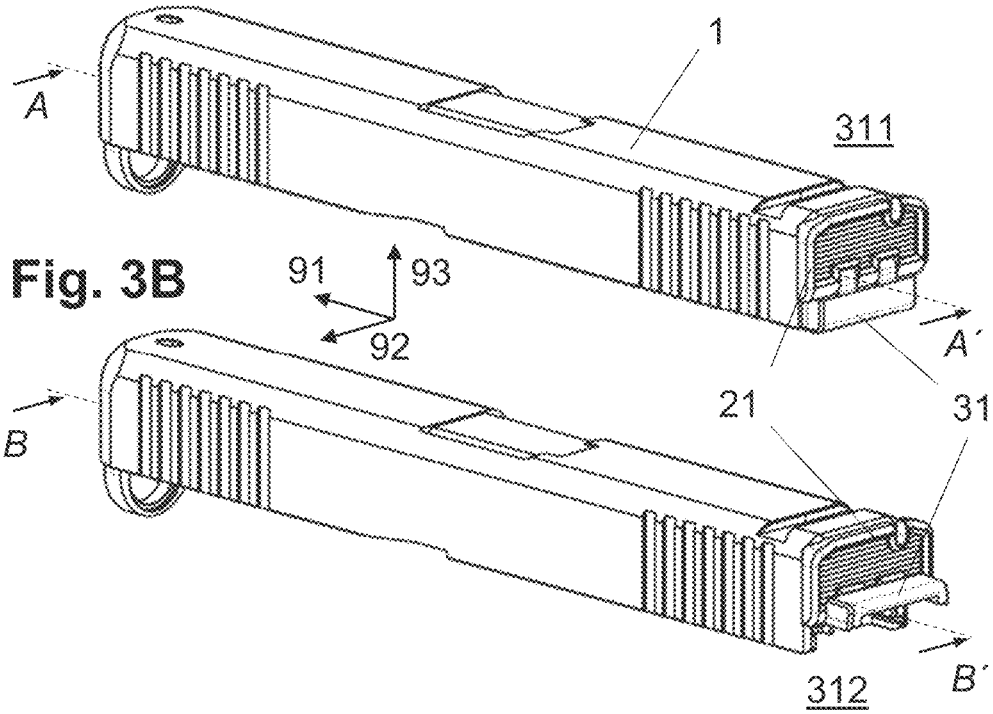
Fig. 3B
Fig. 4 A-A´
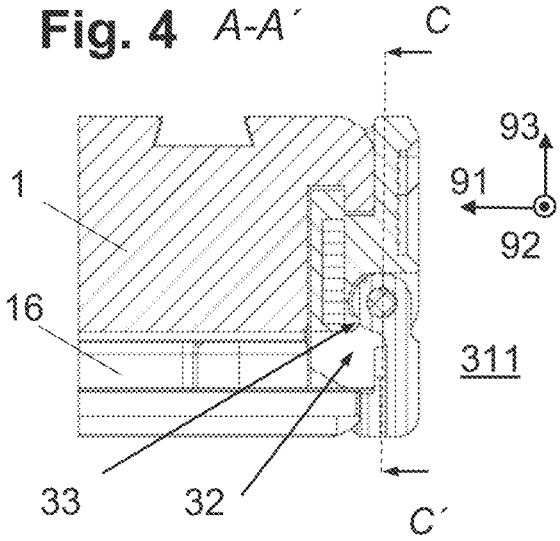
Fig. 5 B-B´
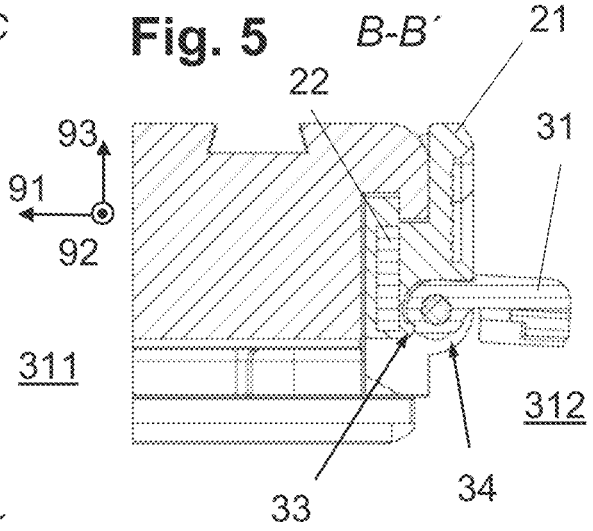

Fig. 9 *A-A´*
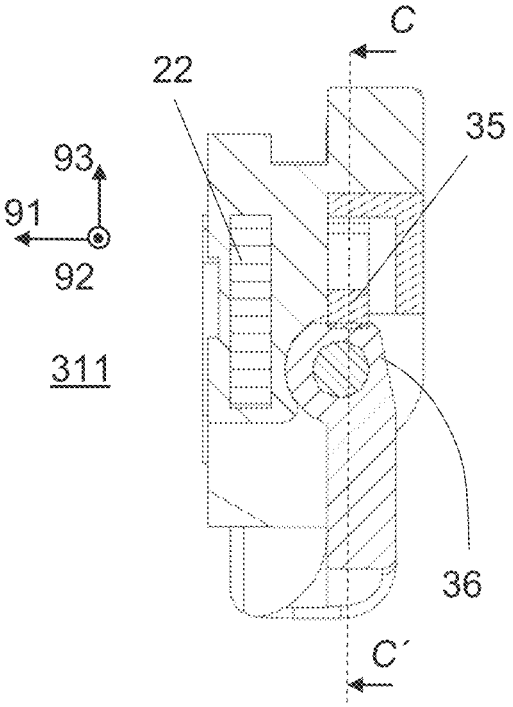
Fig. 10 *B-B´*
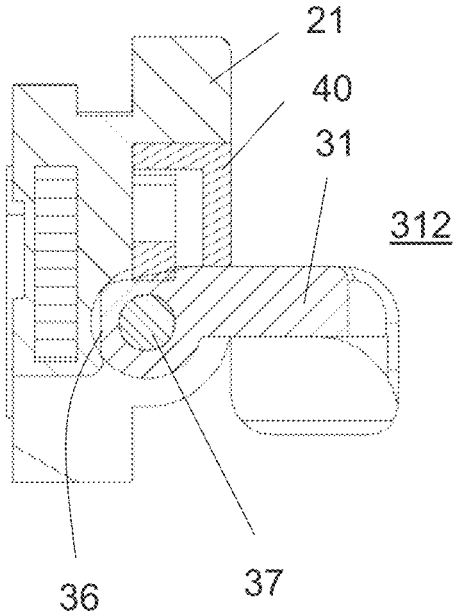
Fig. 11
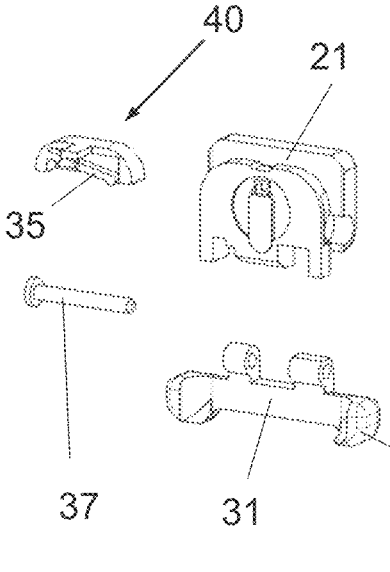
Fig. 12
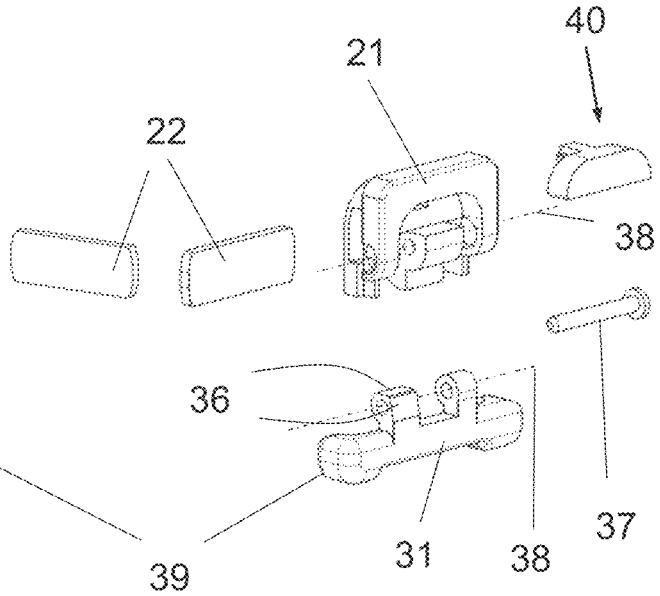

Fig. 17 A-A´
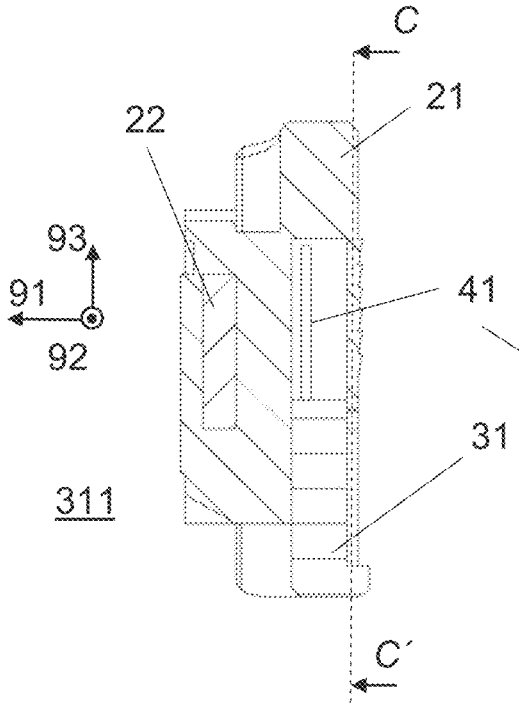
Fig. 18 B-B´
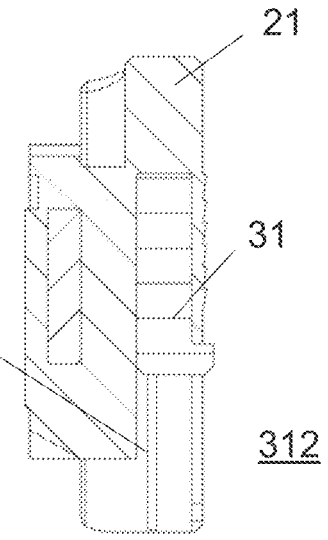
Fig. 19
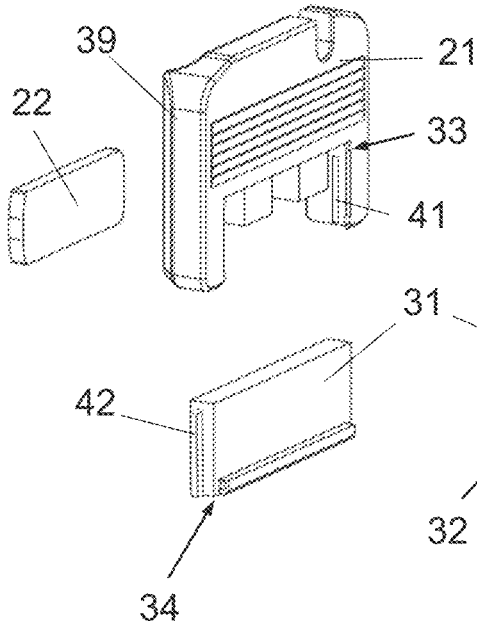
Fig. 20 C-C´
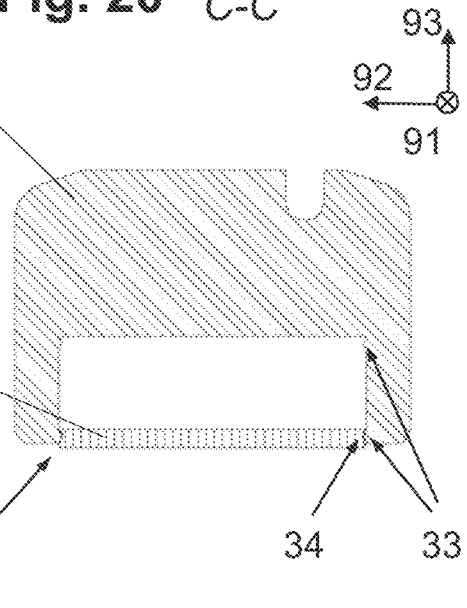

MULTIFUNCTIONAL SLIDE COVER PLATE

TECHNICAL FIELD

This disclosure relates to firearms, in particular to handguns, and more specifically to slide cover plates for the slide of a pistol.

BACKGROUND

During the routine operation of a handgun, and in particular for pistols, after firing the empty cartridge case should be removed from the cartridge chamber of the handgun as reliably as possible before a new cartridge is supplied by the reloading mechanism.

To ensure such smooth operation, pistols typically include a slide locking mechanism. Upon firing, for example, the resulting recoil will urge the slide of the pistol rearward (i.e., away from the barrel) and, depending on the pistol model, the motion can also be accompanied by a tilting movement of the barrel. During this linear movement of the slide, the cartridge case is extracted from the cartridge chamber, inter alia, and the process of ejecting the cartridge or case is completed. During the course of this process, the trigger or a trigger apparatus can also be tensioned, and a reloading process can take place, to place the pistol into condition to be able to fire a cartridge again. Such trigger apparatus very often include a large number of components, and are preferably arranged within the frame of the pistol. In addition, during the movement of the slide certain assemblies arranged in the frame of the pistol, such as the trigger apparatus, can interact with assemblies arranged in the slide of the pistol, such as a firing pin device. Such assemblies, such as for example the firing pin device, the extractor unit, and/or safeties are therefore often arranged in the slide. The respective sequences and manufacturer-related peculiarities of such individual assemblies are sufficiently known to a person skilled in the art and therefore do not require any further explanation at this point.

Upon the introduction of GLOCK pistols in the 1980's, the concept of arranging the firing pin devices of pistols in the pistol slide became widespread. For pistols having such a mechanism, the slide is usually closed on the rear side, i.e. in the direction facing the shooter, by means of a slide cover plate such that the firing pin device, and potentially also the extractor unit, in the slide is secured against falling out. Such slide cover plates have been described, for example, in U.S. Pat. No. 9,664,471 B1, U.S. Pat. No. 10,139,174 B2 and also in WO 2020157528 A1 (each of which is hereby incorporated by reference).

The pistol slide is generally separable from the pistol frame in order to permit a partial dismantling of the pistol (sometimes referred to as "fieldstripping"). The slide and frame are very often connected to one another via guide elements and/or guide rails having complementary shapes, and that can be separated after unlocking. Typically, the slide can be separated by urging it forward (i.e. toward the barrel, or muzzle) from the frame of the pistol.

Very often, however, the multiple individual components that may be arranged in the pistol frame, such as an ejector and/or a cam spring, and assemblies arranged with the cartridge and/or in the slide for the function of the pistol, such as the firing pin device, can interact in the movement path of the slide. For this reason, slide cover plates that incorporate one or more recesses can be found in the prior art. These slide cover plate recesses are typically designed such that those components protruding from the frame in the vertical direction are exposed, and the slide can be pulled. The slide cover plates are often designed in the vertical direction such that the guide rail of the slide remains free, in order that the guide elements remain clear when the slide is pulled. These relationships are known to the person skilled in the art and therefore do not need to be explained in further detail.

Additionally, a connection between the interior of the pistol and the surroundings can be formed by means of a gap between the slide and the frame and recesses provided on the rear face of the slide.

However, in addition to contributing to the facile dismantling of the pistol, such recesses can also serve, for example, in a maritime environment or when using the pistol after it has been submerged in water, to allow water to escape from the interior of the pistol more easily. In a few fields of use, such as in desert regions, however, dust and/or sand may get onto and/or into the pistol via the same recesses.

In order to preserve the low-friction operation of the various movement processes of a pistol, it is desirable that the penetration of foreign bodies, such as sand, dust, mud and the like, into the interior of the pistol be reduced or, at best, completely prevented.

What is needed therefore is a slide cover plate for the slide of a pistol that shields the interior of the pistol from the outside environment to the greatest possible extent. In addition, such a slide cover plate should make the pistol easier to operate, in particular with regard to dismantling and/or actuation of the slide during the loading process.

SUMMARY

The present disclosure is directed to slide cover plates for handguns, and in particular for pistols.

For example, the disclosure may include a slide cover plate for a slide of a pistol, including a primary slide cover plate, where the primary slide cover plate is configured to be inserted into a complementary slide cover plate uptake formed on the slide, and/or is configured to support at least one firing pin device, a sealing cover plate coupled with and movable relative to the primary slide cover plate, where the sealing cover plate can move between an open position and a closed position, such that the sealing cover plate covers the slide when in its closed position.

In another example, the disclosure may include a pistol having a frame, a slide, movably coupled to the frame, a primary slide cover plate, where the primary slide cover plate is configured to be inserted into a complementary slide cover plate uptake formed on the slide, and/or is configured to support at least one firing pin device, and a sealing cover plate coupled with and movable relative to the primary slide cover plate, wherein the sealing cover plate can move between an open position and a closed position, such that the sealing cover plate covers a rear face of the slide when in its closed position.

The disclosed features, functions, and advantages of the disclosed apparatus, systems, and methods may be achieved independently in various embodiments of the present disclosure, or may be combined in yet other embodiments, further details of which can be seen with reference to the following description and drawings.

BRIEF DESCRIPTION OF THE DRAWINGS

FIG. 3A depicts a pistol slide including a slide cover plate according to the present disclosure in the closed position.

FIG. 3B depicts the pistol slide and slide cover plate of FIG. 3A in the closed position.

FIG. 4 depicts a cross section view along a vertical plane that includes the longitudinal axis A-A' as shown in FIG. 3A.

FIG. 5 depicts a cross section view along a vertical plane that includes the longitudinal axis B-B' as shown in FIG. 3B.

FIG. 9 depicts a cross section view through the slide cover plate of FIG. 2C along a vertical plane A-A' analogous to that shown in FIG. 4.

FIG. 10 depicts a cross section view through the slide cover plate of FIG. 2C along a vertical plane B-B' analogous to that shown in FIG. 5.

FIG. 11 is a schematic perspective and exploded view of the slide cover plate of FIG. 2C.

FIG. 12 is an alternative schematic perspective and exploded view of the slide cover plate of FIG. 2C.

FIG. 17 depicts a cross section view of the slide cover plate of FIG. 2D along a vertical plane A-A' analogous to that shown in FIG. 4.

FIG. 18 depicts a cross section view of the slide cover plate of FIG. 2D along a vertical plane B-B' analogous to that shown in FIG. 5.

FIG. 19 is a schematic perspective and exploded view of the slide cover plate of FIG. 2D.

FIG. 20 depicts a cross section view along the vertical plane C-C' as shown in FIG.
17.

DETAILED DESCRIPTION

In the description and claims, the terms "forward", "rearward", "top", "bottom", "left", "right" and so on are used in the common form and with reference to the object in its normal position of use. This means that, in the case of a handgun, the muzzle of the barrel is "forward", the breech or slide is moved "rearward" by the explosion gases, etc. Additionally, a handgun typically includes a vertical plane passing through the barrel axis which defines a general plane of symmetry for the handgun, even where the handgun may not be precisely mirror-symmetric in every detail.

The slide cover plates of the present disclosure include a primary cover plate portion and a sealing cover plate portion, where the sealing cover plate portion is movably coupled to the primary cover plate portion so that the sealing cover plate portion can be disposed in an open position or a closed position. When the sealing cover plate portion is in its closed position the slide cover plate provides excellent protection for the inner workings of the pistol from environmental hazards, while when the sealing cover plate portion is in its open position the slide cover plate does not interfere with the forward movement of the pistol slide during disassembly. The disclosed slide cover plates may therefore also be referred to as multifunctional slide cover plates, convertible slide cover plates, adaptable slide cover plates, and the like.

Figure 1:
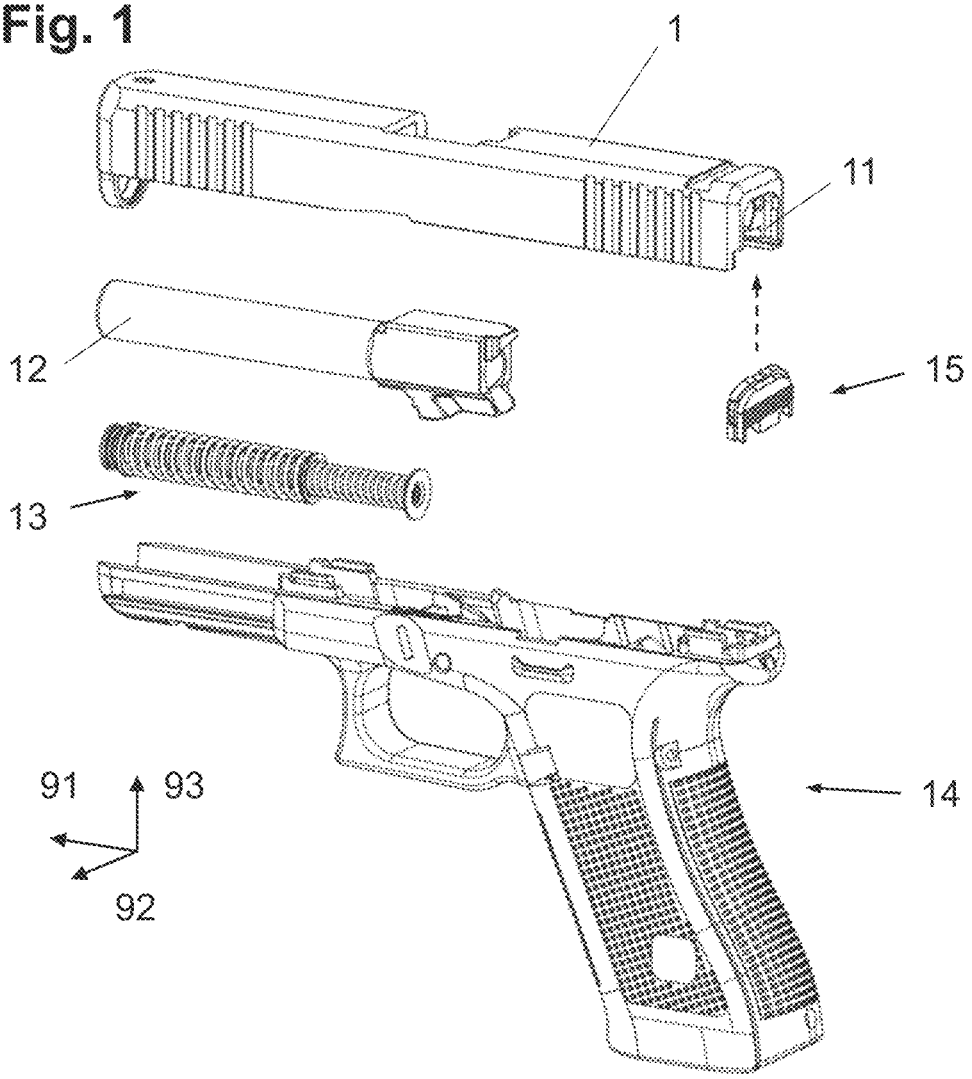
FIG. 1 is schematic exploded view of a pistol.

FIG. 1 shows an exploded view of a representative pistol having only some selected main assemblies, such as a slide 1, a barrel 12, a recoil spring assembly or return spring assembly 13 and a frame or receiver 14. A groove-shaped slide cover plate uptake 11 is formed on slide 1 in the rear region, in which uptake a conventional slide cover plate 15 or a slide cover plate 2 of the present disclosure can be at least partially received. FIG. 1 is representative of all of the embodiments described herein, and is primarily intended to provide a better understanding of the orientation, installation, and operation of the slide cover plate 2 of the present disclosure.

Figures 2A, 2B, 2C, 2D:
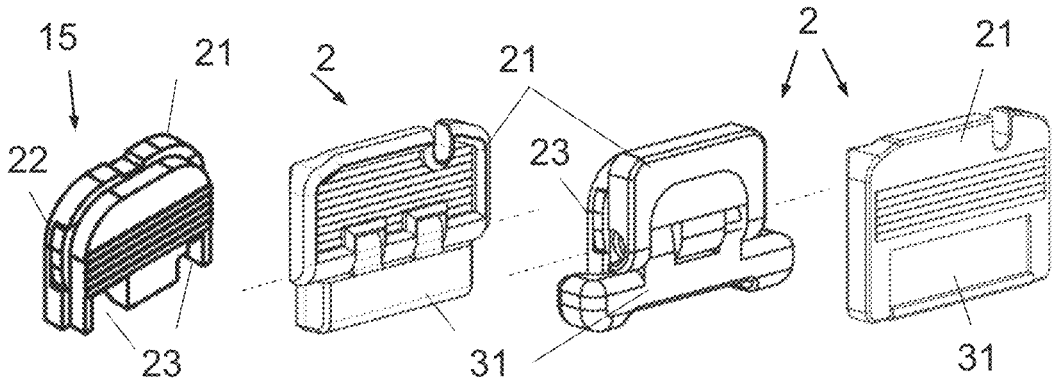
FIG. 2A depicts a prior art slide cover plate.
FIG. 2B depicts an illustrative embodiment of a slide cover plate, according to the present disclosure.
FIG. 2C depicts an alternative illustrative embodiment of a slide cover plate, according to the present disclosure.
FIG. 2D depicts another alternative illustrative embodiment of a slide cover plate, according to the present disclosure.

A previously described slide cover plate 15 is shown in FIG. 2A, while FIGS. 2B, 2C and 2D show selected and exemplary embodiments of slide cover plates 2 according to the present disclosure. Slide cover plate 15 shown in FIG. 2A can often be installed in pistols in a known manner. As shown, slide cover plate 15 substantially consists only of the primary slide cover plate 21, which is designed to be pushed into the slide cover plate uptake 11 and to close the slide 1 on the rear side (see the dashed movement arrow in FIG. 1). A back plate 22, which is typically made of metal and can be used to stiffen slide cover plate 15, can be accommodated within slide cover plate 15. Two recesses 23 can be seen on the lower face of slide cover plate 15, which recesses 23 are used as passages for the ejector and the cam spring when slide 1 is removed from frame 14.

The slide cover plates 2 of FIGS. 2B, 2C, and 2D each include a sealing cover plate portion 31 that is movable relative to a primary slide cover plate 21 that is modified with respect to conventional slide cover plate 15. The embodiments depicted in FIGS. 2B and 2C are formed with a pivotable sealing cover plate portion 31, while the embodiment of FIG. 2D is shown to include a displaceable sealing cover plate portion 31. The embodiments of FIGS. 2B, 2C, and 2D are representative of the presently disclosed slide cover plate 2, and will be discussed in greater detail below. These embodiments are not in any sense exclusive, and various arrangements and combinations of features of the disclosed slide cover plates, whether explicitly disclosed or not, are included within the scope of the present disclosure. For example, a combination of pivotable and displaceable sealing cover plates 31 are included in the present disclosure.

An exemplary pistol slide 1 including a mounted slide cover plate 2 is shown in a closed position 311 in FIG. 3A and in an open position 312 in FIG. 3B. When disposed in the open position 312, it can be clearly seen that sealing cover plate portion 31 can be pivoted toward the rear of the pistol sufficiently as to release the path of movement for pulling slide 1 forward, i.e. in the barrel direction 91, even if the aforementioned components of frame 14 are not shown for the sake of simplicity.

The closed position 311 and the open position 312 of slide cover plate 2 can be seen particularly clearly in the cross-sectional views of FIGS. 4 and 5, respectively, particularly in conjunction with FIGS. 3A and 3B. FIG. 4 depicts a cross-sectional view along the plane A-A' of slide cover plate 2 as indicated in FIG. 3A when the slide cover plate is arranged in its closed position 311. Analogously, FIG. 5 depicts a cross-sectional view along plane B-B' of slide cover plate 2 as indicated in FIG. 3B when the slide cover plate is arranged in its open position 312. In the views of FIGS. 4 and 5 the sections shown do not extend through the center plane of the pistol slide 1 and slide cover plate 2, but rather pass through the first third of the pistol slide when viewed in the normal direction 92 (e.g. from the left side of the pistol slide). The sections therefore are disposed approximately at the level of the hinge joints, as shown.

In FIGS. 4 and 5 a snap mechanism 32 can be clearly seen that is configured to reversibly retain sealing cover plate portion 31 in an open position and/or in a closed position. In particular, and as shown in the present embodiment, snap mechanism 32 can be formed by a snap protrusion 33 on the primary slide cover plate 21 in cooperation with two snap grooves 34 formed on the sealing cover plate portion 31. With the aid of such a snap mechanism 32, two snap positions 33 can be formed in a relatively simple manner, where the two snap positions correspond to the closed and open positions 311 and 312, respectively.

Furthermore, from FIGS. 4 and 5, in conjunction with FIGS. 1 and 3, it can be seen that slide grooves 16 are completely released when slide cover plate 2 is in its open position 312, thereby permitting slide 1 to be pulled. This relationship applies analogously in other embodiments of the disclosed slide cover plate, and therefore need not be explained separately.

Figure 6:
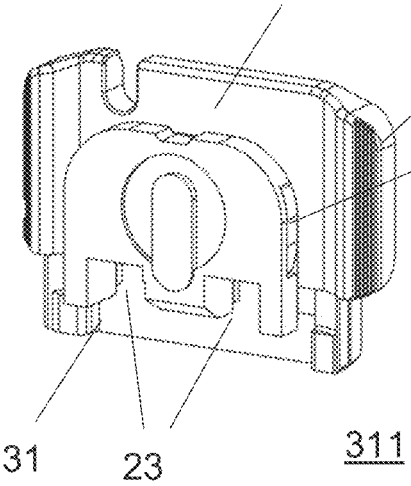
FIG. 6 is a schematic perspective view of an illustrative slide cover plate according to the present disclosure.

FIG. 6 provides an oblique perspective view of the front of an alternative and illustrative slide cover plate 2. As shown, the primary slide cover plate 21 can be seen, in which a back plate 22 can be accommodated. Also shown are recesses 23 defined in primary slide cover plate 21, it can therefore be readily understood that when the sealing cover plate portion 31 is in its closed position 311, the combination of primary slide cover plate 21 and sealing cover plate portion 31 seals slide 1 relatively well at the rear.

Figure 7:
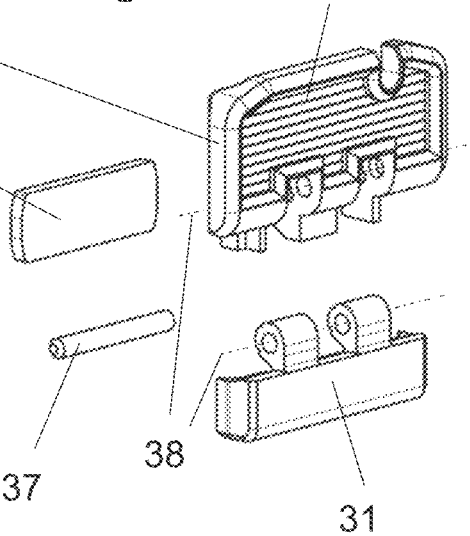
FIG. 7 is an exploded view of the slide cover plate of FIG. 6.
Figure 8:
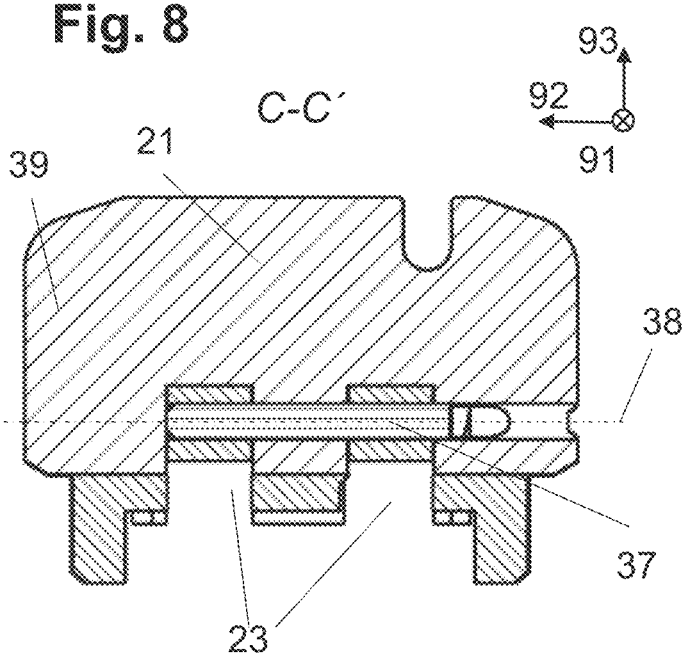
FIG. 8 depicts a cross section view along the vertical plane C-C' as shown in FIG.
4.

FIG. 7 provides an oblique perspective view of the rear of the slide cover plate 2 of FIG. 6 in an exploded view. In conjunction with FIG. 8, which shows a cross section in the barrel direction 91 along the plane C-C' as indicated in FIG. 4, the formation of a hinge joint is clearly depicted, where the hinge joint includes a pin 37 coupling primary slide cover plate 21 with sealing cover plate portion 31 such that sealing cover plate portion 31 is able to pivot about a pivot axis 38.

An additional recess 23 on an upper edge of slide cover plate 2 can also be seen in FIGS. 2B, 3A, 3B, and FIGS. 6 to 8. This additional recess 23 can be provided on the primary slide cover plate 21 in order to facilitate the dismantling or assembly of the extractor unit, for example in order to actuate it using a dismantling pin.

A particularly preferred aspect of the disclosed slide cover plates is shown in the embodiment of FIGS. 6 and 7, according to which embodiment projecting protrusions 39 are formed that project laterally over the width of at least one side of slide 1. These protrusions 39 can be used to facilitate the actuation of the slide 1 during a manual loading process, which in turn provides the disclosed slide cover plate 2 an additional advantage.

An additional illustrative example of the slide cover plate 2 of the present disclosure is shown in greater detail in FIGS. 9 to 13. FIG. 9 provides a cross sectional view of the slide cover plate 2 in the normal direction 92 through the rear region of slide 1, when in the closed position 311, analogously to the view of FIG. 4. Similarly, FIG. 10 provides a cross-sectional view of the slide cover plate in its open position 312, analogously to FIG.

5. The slide cover plate of FIGS. 9 to 13 is additionally provided with a sealing cover plate portion 31 that is pivotable about a pivot axis 38. In addition, the depicted slide cover plate includes an exemplary biasing mechanism 35 as can be seen from the views of FIGS. 9 and 10 in conjunction with FIGS. 11 to 13, where biasing mechanism 35 may in principle be used in conjunction with every other embodiment of slide cover plate 2 disclosed herein The assembly of the depicted slide cover plate 2 can be well understood with reference to the exploded views of FIGS. 11 and 12. In this particular example, biasing mechanism 35 can be installed by means of a mounting element 40 that can be inserted into primary slide cover plate 21 from behind. Biasing mechanism 35 is in this case integrally formed on mounting element 40 in the form of a type of leaf spring, and is lowered when sealing cover plate portion 31 is installed.

The formation of a flattened region 36 on the hinge joint of sealing cover plate portion 31, as shown in FIG. 12, can advantageously be employed to use biasing mechanism 35 analogously to the function of snap mechanism 32, since the leaf spring can be pretensioned against the flattened regions 36. As a result, as is seen in FIGS. 9 and 10, sealing cover plate portion 31 can thus be held in its closed position 311 or open position 312 by biasing mechanism 35. This is also shown in the cross-sectional view in the barrel direction 91 of FIG. 13, as viewed along the plane C-C' indicated in FIG. 9.

Figure 13:
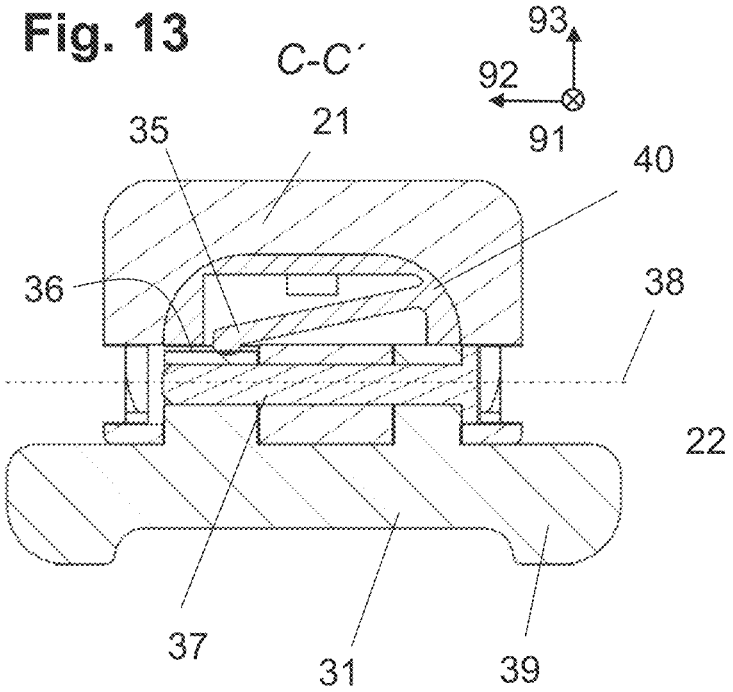
FIG. 13 depicts a cross section view along the vertical plane C-C' shown in FIG. 9.

An alternative structure similar to that of the previous embodiment is shown in FIG. 13, including a pivot axis 38 that extends at right angles to the barrel direction 91 in the normal direction 92. In addition, protrusions 39 that extend laterally along the width of slide 1 can be clearly seen in the quasi-rear view. However, it is easily conceivable for pivot axis 38 to be formed, for example, in the vertical direction 93, i.e., such that the sealing cover plate portion 31 can be opened in a substantially "door-like" manner.

Figure 14:
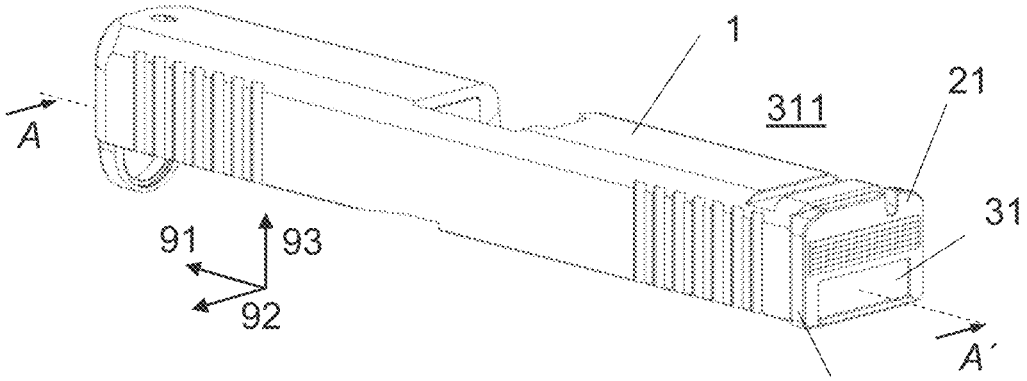
FIG. 14 depicts an illustrative embodiment of a pistol slide including the slide cover plate shown in FIG. 2D in its closed position.
Figure 15:
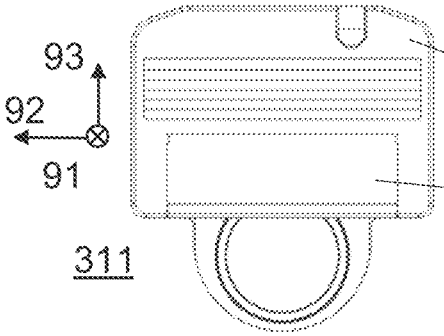
FIG. 15 depicts a rear view of a pistol slide including the slide cover plate of FIG. 2D in its closed position.
Figure 16:
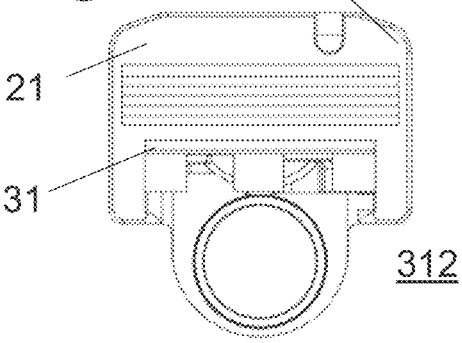
FIG. 16 depicts a rear view of a pistol slide including the slide cover plate of FIG. 2D in its open position.

An additional embodiment of a slide cover plate 2 is shown in FIG. 14 as installed in a slide 1 in its closed position 311. In this example the sealing cover plate portion 31 is displaceable relative to the primary slide cover plate 21. The displacement of sealing cover plate portion 31 when transitioning from the closed position 311 to the open position 312 can be oblique or, due to space restrictions, it is more preferable for sealing cover plate portion 31 to be displaced in a direction normal to the barrel direction 91, as can be seen with respect to FIGS. 15 to 19.

As in selected previous embodiments, the lateral protrusions 39 are also formed on the primary slide cover plate 21, but such lateral protrusions should not be considered absolutely necessary or required.

The lateral cross section views along the plane A-A' and B-B' seen in FIGS. 17 and 18, respectively, are analogous to the similar cross section view shown for previous embodiments of the slide cover plate. Due to the symmetrical design of the disclosed embodiment, the position of the precise cutting plane is not essential, but illustrates the possibility of a slide cover plate for which sealing cover plate portion 31 slides between its closed and open positions, rather than pivots.

As shown in FIGS. 19 and 20, sealing cover plate portion 31 can be inserted into the primary slide cover plate 21 from below, and in such a manner that sealing cover plate portion 31 is supported by primary slide cover plate 21 on multiple sides. In principle, it is additionally conceivable that the sealing cover plate portion 31 can be configured to be laterally displaceable, for example in the normal direction 92.

In the case of those embodiments of slide cover plate 2 that include a displaceable sealing cover plate portion 31, it may be particularly advantageous for sealing cover plate portion 31 to be connected to primary slide cover plate 21 via at least one sliding connection, or an interacting pair of guides. Such an interacting pair of guides can be formed on one side or, as is clearly visible in FIGS. 17 to 19, can also be formed on both sides. The interacting pair of guides can thus have at least one guiding notch 41 that is complementary in shape and function with a corresponding guiding protrusion 42. The particular orientation or arrangement of these elements can, of course, be arranged inversely on the primary slide cover plate 21 and sealing cover plate portion 31. such guides can be designed as simple tongue-and-groove connections or, for example as a dovetail connection in order to impede tilting in a direction normal to the displacement direction.

The slide cover plates of the present disclosure can also be configured so that sealing cover plate portion 31 will not disappear completely inside the primary slide cover plate 21, as in the preferred variant shown, but rather has sealing cover plate portion 31 arranged outside the primary slide cover plate 21. In this variant, the subsequently formed features can also be arranged at least partially outside of the primary slide cover plate 21, such as a pair of guides or a snap mechanism 32.

As noted above, the displaceable variants can also incorporate a biasing mechanism 35, that preferably urges sealing cover plate portion 31 into its closed position 311. For reasons of clarity, such a representation is not shown, but it is easily possible for a person skilled in the art to provide a suitable biasing mechanism 35 with the aid of the present disclosure. For example, a leaf spring can be formed, preferably integrally, on the slider-shaped sealing cover plate portion 31. See, for example, the explanations with respect to the second embodiment.

Alternatively, or in addition, one or more snap mechanisms 32 can be combined very well with a displaceably arranged sealing cover plate portion 31, as shown by way of example in FIGS. 19 and 20. The cross section view along plane C-C' depicted in FIG. 20 is selected in accordance with FIG. 17 such that the snap protrusions 33 on the primary slide cover plate 21 and the snap grooves 34, which are complementary in shape and function, can be seen particularly well. This snap mechanism 32 can also be formed optionally, for example, if a biasing mechanism 35 is provided and the sealing cover plate portion 31 is to be held in the open position 312 to further simplify operability. It is also conceivable to provide an additional element, such as a mounting element 40 for arranging a snap mechanism 32 and/or a biasing mechanism 35, or also a sliding connection.

A particularly preferred embodiment of the presently disclosed slide cover plates can also be seen in FIG. 19, as well as disclosed in the preceding description, in which surface structuring can be provided on at least one outer surface, and/or on the outer contour. This not only has the advantage of simple actuation, but also that handling away from the field of vision can be facilitated by touch.

SELECTED EXAMPLES

This section describes additional aspects and features of the disclosed slide covering plates, and pistols incorporating the disclosed slide covering plates, presented without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

A1. A multifunctional slide cover plate (2) for the slide (1) of a pistol, comprising a basic slide cover plate (21) which is designed for insertion into a slide cover plate uptake (11) of the slide (1) that is provided for this purpose, and/or for supporting at least one firing pin device, characterized in that a sealing cover plate (31) is formed that is movable relative to the basic slide cover plate (21) between an open position (312) and a closed position (311) and covers, preferably closes off, the slide (1) to the outside counter to the barrel direction (91) in the closed position (311).

A2. The multifunctional slide cover plate (2) according to paragraph A1, characterized in that at least one snap mechanism (32) is formed on the basic slide cover plate (21) and/or the sealing cover plate (31) for temporarily fixing the sealing cover plate (31) in the open position (312) and/or the closed position (311).

A3. The multifunctional slide cover plate (2) according to paragraph A2, characterized in that the snap mechanism (32) comprises a snap protrusion (33) on the basic slide cover plate (21) and at least one snap groove (34) on the sealing cover plate (31).

A4. The multifunctional slide cover plate (2) according to one of the preceding paragraphs, characterized in that a biasing mechanism (35) is designed to apply a preload to the sealing cover plate (31) direction of the closed position (311).

A5. The multifunctional slide cover plate (2) according to paragraph A4, characterized in that the sealing cover plate (31) has a flattening (36) for interacting with the biasing mechanism (35) in order to apply the preload.

A6. The multifunctional slide cover plate (2) according to either paragraph 4 or paragraph 5, characterized in that the biasing mechanism (35) has a leaf spring which is preferably integrally formed on the basic slide cover plate (21) and/or a mounting element (40).

A7. The multifunctional slide cover plate (2) according to any of the preceding paragraphs, characterized in that the sealing cover plate (31) is formed on the basic slide cover plate (21) so as to be rotatable or pivotable about a pivot axis (38) which preferably extends in the normal direction (92).

A8. The multifunctional slide cover plate (2) according to any of paragraphs A1 to A6, characterized in that the sealing cover plate (31) is displaceable on and/or at least partially within the basic slide cover plate (21).

A9. The multifunctional slide cover plate (2) according to paragraph A8, characterized in that at least one interacting guiding pair, comprising at least one guiding notch (41) and a guiding protrusion (42), is formed on or at least partially within the sealing cover plate (31) or the basic slide cover plate (21) for movement.

A10. The multifunctional slide cover plate (2) according to any of the preceding paragraphs, characterized in that the basic slide cover plate (21) and/or the sealing cover plate (31) has protrusions (39) which project laterally with respect to the slide (1) on at least one side.

A11. The multifunctional slide cover plate (2) according to any of the preceding paragraphs, characterized in that the basic slide cover plate (21) and/or the sealing cover plate (31) and/or a protrusion (39) has surface structuring on the outer surface thereof.

A12. A handgun, in particular a pistol, having a slide (1) and a multifunctional sealing cover plate (2) according to any of the preceding paragraphs A1 to A11.

Conclusion

In the description and the claims, "substantially" means a deviation of up to 10% of the stated value, if physically possible, both downward and upward, otherwise only in the appropriate direction. The term: "combination" or "combinations," unless otherwise stated, mean all types of combinations, starting from two of the relevant components up to a plurality or all of such components.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

The disclosure set forth above may encompass multiple distinct examples with independent utility. Although each of these has been disclosed in one or more illustrative form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

Listing of Reference Numerals

| | | | |
|---|---|---|---|
| 1 | Slide | 31 | Sealing cover plate portion |
| 11 | Slide cover plate uptake | 311 | Closed position |
| 12 | Barrel | 312 | Open position |
| 13 | Recoil spring assembly | 32 | Snap mechanism |
| 14 | Frame | 33 | Snap protrusion |
| 15 | Slide cover plate | 34 | Snap groove |
| 16 | Slide grooves | 35 | Biasing mechanism |
| | | 36 | Flattening |
| 2 | Slide cover plate | 37 | Pin |
| 21 | Primary slide cover plate | 38 | Pivot axis |
| 22 | Back plate | 39 | Protrusion |
| 23 | Recess e.g. for ejector, cam spring | 40 | Mounting element |
| | | 41 | Guiding notch |

-continued

Listing of Reference Numerals

| | |
|---|---|
| 42 | Guiding protrusion |
| 91 | Barrel direction |
| 92 | Normal direction |
| 93 | Vertical direction |

What is claimed is:

1. A slide cover plate for a slide of a pistol comprising:

a primary slide cover plate, wherein the primary slide cover plate is configured to be inserted into a complementary slide cover plate uptake formed on the slide, and/or is configured to support at least one firing pin device; and a sealing cover plate portion coupled with and movable relative to the primary slide cover plate, wherein the sealing cover plate portion can move between an open position and a closed position, such that the sealing cover plate portion covers the slide when in its closed position.

2. The slide cover plate of claim 1, wherein when the sealing cover plate portion is in its closed position, the sealing cover plate portion closes a rear side of the slide to an outside of the pistol.

3. The slide cover plate of claim 1, further comprising at least one snap mechanism formed on the primary slide cover plate and/or the sealing cover plate portion, where the snap mechanism is configured to reversibly retain the sealing cover plate portion in its open position and/or in its closed position.

4. The slide cover plate of claim 3, wherein the at least one snap mechanism includes a snap protrusion formed on the primary slide cover plate, and at least one snap groove formed on the sealing cover plate portion.

5. The slide cover plate of claim 1, further comprising a biasing mechanism that applies a preload to the sealing cover plate in a direction of the closed position of the sealing cover plate portion.

6. The slide cover plate of claim 5, wherein the sealing cover plate has a flattened region for interacting with the biasing mechanism in order to apply the preload to the sealing cover plate portion.

7. The slide cover plate of claim 5, wherein the biasing mechanism includes a leaf spring that is formed on the primary slide cover plate and/or that is formed on a mounting element on the primary slide cover plate.

8. The slide cover plate of claim 7, wherein the leaf spring is integrally formed on the primary slide cover plate and/or integrally formed on the mounting element.

9. The slide cover plate of claim 1, wherein the sealing cover plate portion is coupled to the primary slide cover plate in such a way as to be rotatable or pivotable about a pivot axis.

10. The slide cover of claim 9, wherein the pivot axis extends in a direction normal to a barrel direction of the pistol.

11. The slide cover plate of claim 1, wherein the sealing cover plate portion is displaceable on, and/or at least partially within, the primary slide cover plate.

12. The slide cover plate of claim 11, further comprising at least one interacting pair of guides formed on, or at least partially within, the sealing cover plate portion or the primary slide cover plate; wherein the interacting pair of guides includes at least one guiding notch and a corresponding guiding protrusion that guide a displacement of the sealing cover plate portion.

13. The slide cover plate of claim 1, wherein the primary slide cover plate and/or the sealing cover plate portion include one or more protrusions that project laterally from at least one side of the slide.

14. The slide cover plate of claim 1, wherein at least one of the primary slide cover plate, the sealing cover plate portion, and a protrusion that projects laterally from at least one side of the slide include surface structuring on an outer surface thereof.

15. A pistol, comprising a slide and a slide cover plate according to claim 1.

16. A pistol, comprising:

a frame;

a slide, movably coupled to the frame;

a primary slide cover plate, wherein the primary slide cover plate is configured to be inserted into a complementary slide cover plate uptake formed on the slide, and/or is configured to support at least one firing pin device; and a sealing cover plate portion coupled with and movable relative to the primary slide cover plate, wherein the sealing cover plate portion can move between an open position and a closed position, such that the sealing cover plate portion covers a rear face of the slide when in its closed position.

* * * * *